US007591119B2

(12) United States Patent
Ritz

(10) Patent No.: US 7,591,119 B2
(45) Date of Patent: Sep. 22, 2009

(54) METHOD AND APPARATUS FOR INCREASING THE CAPACITY AND STABILITY OF A SINGLE-POLE TOWER

(75) Inventor: Charles D. Ritz, Norcross, GA (US)

(73) Assignee: Ritz Telecommunications, Inc., Norcross, GA (US)

( * ) Notice: Subject to any disclaimer, the term of this patent is extended or adjusted under 35 U.S.C. 154(b) by 804 days.

(21) Appl. No.: 10/184,021

(22) Filed: Jun. 27, 2002

(65) Prior Publication Data

US 2003/0033281 A1 Feb. 13, 2003

Related U.S. Application Data

(63) Continuation of application No. 09/706,216, filed on Nov. 3, 2000, now Pat. No. 6,453,636, which is a continuation of application No. 09/557,266, filed on Apr. 24, 2000, now abandoned.

(51) Int. Cl.
*E04B 1/00* (2006.01)

(52) U.S. Cl. ..... 52/835; 52/834; 52/843

(58) Field of Classification Search ..... 52/298, 52/736.4, 736.2, 736.1, 736.3, 723.1, 651.01; 248/548, 679
See application file for complete search history.

(56) References Cited

U.S. PATENT DOCUMENTS 985,605 A * 2/1911 Konopinski ..... 52/723.2
1,596,657 A * 8/1926 Heber ..... 52/168
1,947,413 A * 2/1934 Hay ..... 249/1
2,897,553 A 8/1959 Gorrow
3,303,506 A 2/1967 Diebold
3,400,905 A * 9/1968 Van Dusen, Jr. ..... 403/369
3,959,946 A 6/1976 Holmes et al.
4,066,372 A * 1/1978 Swanson et al. ..... 403/302
4,092,079 A * 5/1978 Swanson ..... 403/306
4,242,851 A 1/1981 Pohlman et al.
4,295,317 A 10/1981 VanTielen
4,388,787 A * 6/1983 Milbright ..... 52/298
4,503,645 A 3/1985 Nudd et al.
4,687,380 A 8/1987 Meek et al.
4,745,412 A 5/1988 Creaser, Jr.
4,779,389 A 10/1988 Landers
4,987,718 A 1/1991 Knight
4,991,367 A 2/1991 McGinnis
5,090,165 A 2/1992 Kenny
5,117,607 A 6/1992 Bourdon (Continued)

OTHER PUBLICATIONS

Hill et al., "Method and Apparatus for Increasing the Capacity and Stability of a Single-Power Tower," U.S. Appl. No. 09/557,266, filed Apr. 24, 2000.

(Continued)

*Primary Examiner*—Basil Katcheves
(74) *Attorney, Agent, or Firm*—Lanier Ford Shaver & Payne, P.C.

(57) ABSTRACT

A support structure for use with an existing single pole tower. The single pole tower has a pole anchored to a foundation and supports a first load. The support structure has a number of sleeves surrounding the pole. A first one of the sleeves is anchored to the foundation. A second load is attached to a second one of the sleeves.

25 Claims, 8 Drawing Sheets

U.S. PATENT DOCUMENTS

| | | | | | |
|---|---|---|---|---|---|
| 5,133,164 | A | | 7/1992 | Legler | |
| 5,271,203 | A | * | 12/1993 | Nagle | 52/721.4 |
| 5,291,709 | A | | 3/1994 | Vranjesevic | |
| 5,317,844 | A | | 6/1994 | Legler | |
| 5,333,436 | A | | 8/1994 | Noble | |
| 5,333,824 | A | | 8/1994 | Dubinsky | |
| 5,345,732 | A | | 9/1994 | Knight et al. | |
| 5,371,986 | A | | 12/1994 | Guditis | |
| 5,383,749 | A | | 1/1995 | Reisdorff et al. | |
| 5,542,229 | A | | 8/1996 | Saito et al. | |
| 5,572,846 | A | * | 11/1996 | Sosa | 52/736.4 |
| 5,573,354 | A | * | 11/1996 | Koch | 405/216 |
| 5,687,537 | A | | 11/1997 | Noble | |
| 5,855,103 | A | | 1/1999 | Moore | |
| 5,870,968 | A | | 2/1999 | Dundorf | |
| 5,878,540 | A | | 3/1999 | Morstein | |
| 5,880,701 | A | * | 3/1999 | Bhame et al. | 343/890 |
| 6,019,549 | A | | 2/2000 | Blair et al. | |
| 6,142,434 | A | | 11/2000 | Trost et al. | |
| 6,167,673 | B1 | | 1/2001 | Fournier | |

OTHER PUBLICATIONS

Ritz, Charles, "Method and Apparatus for Increasing the Capacity and Stability of a Single-Power Tower," U.S. Appl. No. 09/706,216, filed Nov. 3, 200.

* cited by examiner

PLAN AT FOUNDATION

METHOD AND APPARATUS FOR INCREASING THE CAPACITY AND STABILITY OF A SINGLE-POLE TOWER

This application is a continuation of and claims priority benefits to U.S. patent application Ser. No. 09/706,216, entitled "Method and Apparatus for Increasing the Capacity and Stability of a Single-Pole Tower," and filed on Nov. 3, 2000 now U.S. Pat. No. 6,453,636. U.S. patent application Ser. No. 09/706,216 is a continuation of an claims priority benefits to U.S. patent application Ser. No. 09/557,266, entitled "Method and Apparatus for Increasing the Capacity and Stability of a Single-Pole Tower," and filed on Apr. 24, 2000 now abandoned.

TECHNICAL FIELD

The present invention relates generally to a method and an apparatus for increasing the capacity and stability of a single-pole tower. More particularly, the invention relates to a method and an apparatus that employs a sleeve and an array of load transfer pins to add structural stability to a single-pole tower and thereby increase its capacity to support additional equipment and withstand environmental loads.

BACKGROUND OF THE INVENTION

The increase in wireless telecommunications traffic has resulted a concomitant incise in the need for pole-mounted transmission equipment of all kinds. Not only do wireless service providers need to install equipment covering new geographic areas, competing service providers and others also need to install additional equipment covering the same or similar geographic areas. To date, the solution to both problems normally includes purchasing additional land or easements, applying for the necessary government permits and zoning clearances, and constructing a new tower for the new transmission equipment.

Purchasing land or easements, however, is becoming increasingly expensive, particularly in urban areas where the need for wireless telecommunications is greatest. Zoning regulations often limit the construction of new towers in the vicinity of existing towers or may prohibit the construction of new towers in the most suitable locations. The expense and delay associated with the zoning process often may be cost-prohibitive or so time-consuming that construction of the new tower is not feasible. Even when zoning regulations can be satisfied and permits can be obtained, the service provider must then bear the burden and expense associated with the construction and the maintenance of the tower.

The tower itself must be designed to support the weight of the telecommunications transmission equipment as well as the forces exerted on the pole by environmental factors such as wind and ice. The equipment and the environmental factors produce forces known as bending moments that, in effect, may cause a single-pole tower to overturn if not designed for adequate stability. Traditionally, single-pole towers have been designed to withstand the forces expected from the equipment originally installed on the pole. Very few single-pole towers, however, are designed with sufficient stability to allow for the addition of new equipment.

Thus, there is a need for a method and an apparatus for increasing the capacity and stability of a single-pole tower that will support the weight of additional equipment and support the additional environmental forces exerted on the pole. At best, the prior art shows various brackets used for restoring the strength of a weakened or damaged section of a wooden pole. An example of a known pole restoration system is shown in U.S. Pat. No. 4,991,367 to McGinnis entitled, "Apparatus and Method for Reinforcing a Wooden Pole." This reference describes an apparatus that employs a series of braces linked together around the circumference of a tapered pole. The braces are then forced downward on the pole to wedge the assembly tightly against the pole to provide support. This system does not include an anchorage to the ground or base of the pole.

A number of other known pole restoration systems employ a first part attached to the damaged section of the pole and a second part that is driven into the ground to provide support. An example of such a system is shown in U.S. Pat. No. 4,756,130 to Burtelson entitled, "Apparatus for Reinforcing Utility Poles and the Like." This apparatus uses a series of brackets and straps attached to ground spikes. Another example of a known pole restoration system is shown in U.S. Pat. No. 4,697,396 to Knight entitled, "Utility Pole Support." This reference describes an apparatus with a series of brackets attached to a wooden utility pole. A series of tapered spikes are anchored on the brackets and then driven into the ground to provide support. Additional examples of such a system are shown in U.S. Pat. Nos. 5,345,732 and 5,815,994, both issued to Knight & Murray, entitled "Method and Apparatus for Giving Strength to a Pole" and "Strengthening of Poles," respectively. These references describe an apparatus with a nail or bridging beam driven through the center of the wooden pole. The nail is attached by linkages to a series or circumferential spices that are then driven into the ground to provide support.

In each of these systems, the brackets are fixably attached to a damaged wooden utility pole to provide a firm anchor for the ground spikes. The spikes are driven into the ground immediately adjacent the pole to wedge the spike tightly against the side of the pole. The functionality of each of these systems depends, therefore, on the rigid attachment between the pole brackets and the spikes as well as the compression fit of the spikes between the ground and the pole. Further, these ground-based systems only function when the damaged pole section is sufficiently near the ground for the bracket assembly to be attached to the ground spikes. The capacity of these known systems to resist bending moments is dependent upon the height of the damaged section relative to the ground as well as the characteristics of the soil and other natural variables. Moreover, each of these systems describes an apparatus for the purpose of restoring a damaged pole to its original capacity, not for the purpose of bolstering an existing pole to increase its capacity.

Thus, there remains a need for a method and apparatus for increasing the capacity and stability of a single-pole tower that will support the weight of additional equipment and support the additional environmental forces exerted on the pole, while providing sufficient stability to resist the forces known as bending moments exerted by the new equipment and the environmental forces. Such a method and an apparatus should accomplish these goals in a reliable, durable, low-maintenance, and cost-effective manner.

SUMMARY OF THE INVENTION

The present invention provides a method and an apparatus for increasing the capacity and stability of a single-pole tower. The invention thus provides a support structure for use with an existing single pole tower. The single pole tower has a pole anchored to a foundation and supports a first load. The support structure has a number of sleeves surrounding the pole. The sleeves may extend beyond the height of the existing single pole tower. A first one of the sleeves is anchored to the foundation. A second load is attached to a second one of the sleeves.

Specific embodiments of the present invention include the sleeves being made out of a metal such as a structural pipe with a minimum yield stress of about 42 ksi. The sleeves may have a first half and a second half. Each half may have a first side with a first sleeve tab and a second side with a second sleeve tab. The sleeve tabs may have a number of apertures positioned therein. The sleeves also may include a first end with a first flange plate and a second end with a second flange plate. The flange plates also may have a number of apertures positioned therein. The sleeves also may include a number of load transfer pins. The load transfer pins may have a bolt and one or more nuts. The pins extend from the sleeves to the pole so as to stabilize the loads. The pins may be radially spaced around a vertical center axis of the sleeves. The sleeves may include a plurality of access ports positioned therein. The second load may include one or more telecommunications arrays.

There may be a number of sleeves, such as a first sleeve, a second sleeve, and a third sleeve. The second flange plate of first sleeve is anchored to the foundation. The first flange plate of the first sleeve may include a dimension to accommodate the second flange plate of the second sleeve while the first flange plate of the second sleeve may include a dimension to accommodate the second plate of the third sleeve. The first end of the third sleeve may include a cover plate.

Another embodiment of the present invention provides a support structure for supporting a first load and for use with an existing single pole tower. The single pole tower includes a pole anchored to a foundation. The pole supports a second load. The support structure includes a first sleeve attached to the foundation and a second sleeve attached to the first sleeve. The first load is attached to the second sleeve. The sleeves surround the pole. The second sleeve may be attached to the first sleeve via one or more joinder sleeves.

A further embodiment of the present invention provides a support structure for supporting a load and for use with an existing single pole tower. The single pole tower may include a pole anchored to a foundation. The support structure may include a number of sleeves surrounding the pole. One of the sleeves may be anchored to the foundation and another one of the sleeves may support the load. A number of load transfer pins may be positioned along the sleeves. The pins extend from the sleeves to the pole so as to stabilize the load.

A further embodiment of the present invention provides a support structure for supporting a load. The support structure includes a single pole tower and a sleeve surrounding the pole. The pole and the sleeve are anchored to a foundation. The sleeve supports the load. A number of sleeves may be used with a first sleeve anchored to the foundation, a second sleeve supporting the load, and one or more joinder sleeves positioned between the first sleeve and the second sleeve. The pole also may support a second load. The total height of the number of sleeves may extend beyond the height of the existing single pole tower. A number of load transfer pins may be positioned along the sleeve. The pins extend from the sleeve to the pole so as to stabilize the load.

A method of the present invention provides for placing an additional load on a single pole tower. The single pole tower includes a pole anchored to a foundation. The method includes the steps of positioning one or more sleeves around the pole, anchoring the sleeves to the foundation, and supporting the additional load on the sleeves. A first one of the number of sleeves may be anchored to the foundation, a second one of the sleeves may be supporting the additional load, and one or more joinder sleeves may attach the first and the second sleeves. The method may further include the step of attaching a number of load transfer pins to the sleeves so as to stabilize the additional load.

Thus, it is an object of the present invention to provide an improved method and apparatus for increasing the capacity and stability of a single-pole tower.

It is another object of the present invention to provide an improved method and apparatus for increasing the capacity and stability of a single-pole tower wherein the apparatus will support the weight of additional equipment and the additional environmental forces exerted on the pole.

It is still another object of the present invention to provide an improved method and apparatus for increasing the capacity and stability of a single-pole tower wherein the apparatus will support the weight of additional equipment and the additional environmental forces exerted on the pole while also providing sufficient stability to resist the forces known as bending moments caused by the new equipment and the environmental forces.

Other objects, features, and advantages of the present invention will become apparent upon reading the following detailed description of the preferred embodiment of the invention when taken in conjunction with the drawings and the appended claims.

DETAILED DESCRIPTION OF THE DISCLOSED EMBODIMENT

Figure 1:
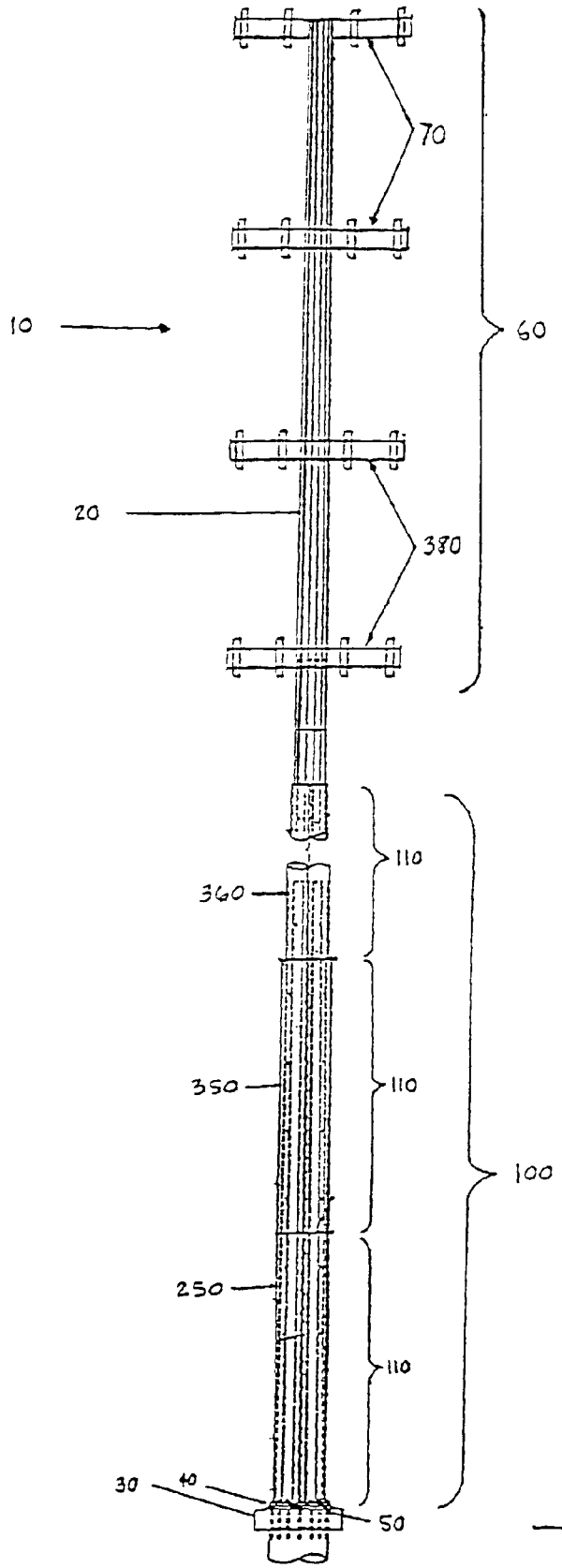
FIG. 1 is a perspective view of the support structure of the present invention surrounding an existing tower.

Referring now in more detail to the drawings, in which like numerals indicate like elements throughout the several views, FIG. 1 shows a single pole tower 10 for use with the present invention. As is well known in the art, the single pole tower 10 generally includes a pole 20 of varying height. The pole 20 is generally a hollow structure made from various types of steel, composite materials, or other types of sufficiently rigid materials. The pole 20 may be a tapered structure such that it decreases in width as its height increases. The pole 20 may be mounted on a foundation 30 by a base plate 40 and a plurality of anchor bolts 50. The foundation 30 is generally a reinforced concrete structure that may by anchored by conventional means. The base plate 40 and the anchor bolts 50 are generally made from various types of steel or other types of sufficiently rigid materials. One or more loads 60 may be fixedly attached to the pole 20. In the present embodiment, the load 60 may include one or more types of conventional telecommunication arrays 70 fixedly attached by bolts or other conventional types of attachment means. Such telecommunication arrays 70 are well known in the art.

Figure 2:
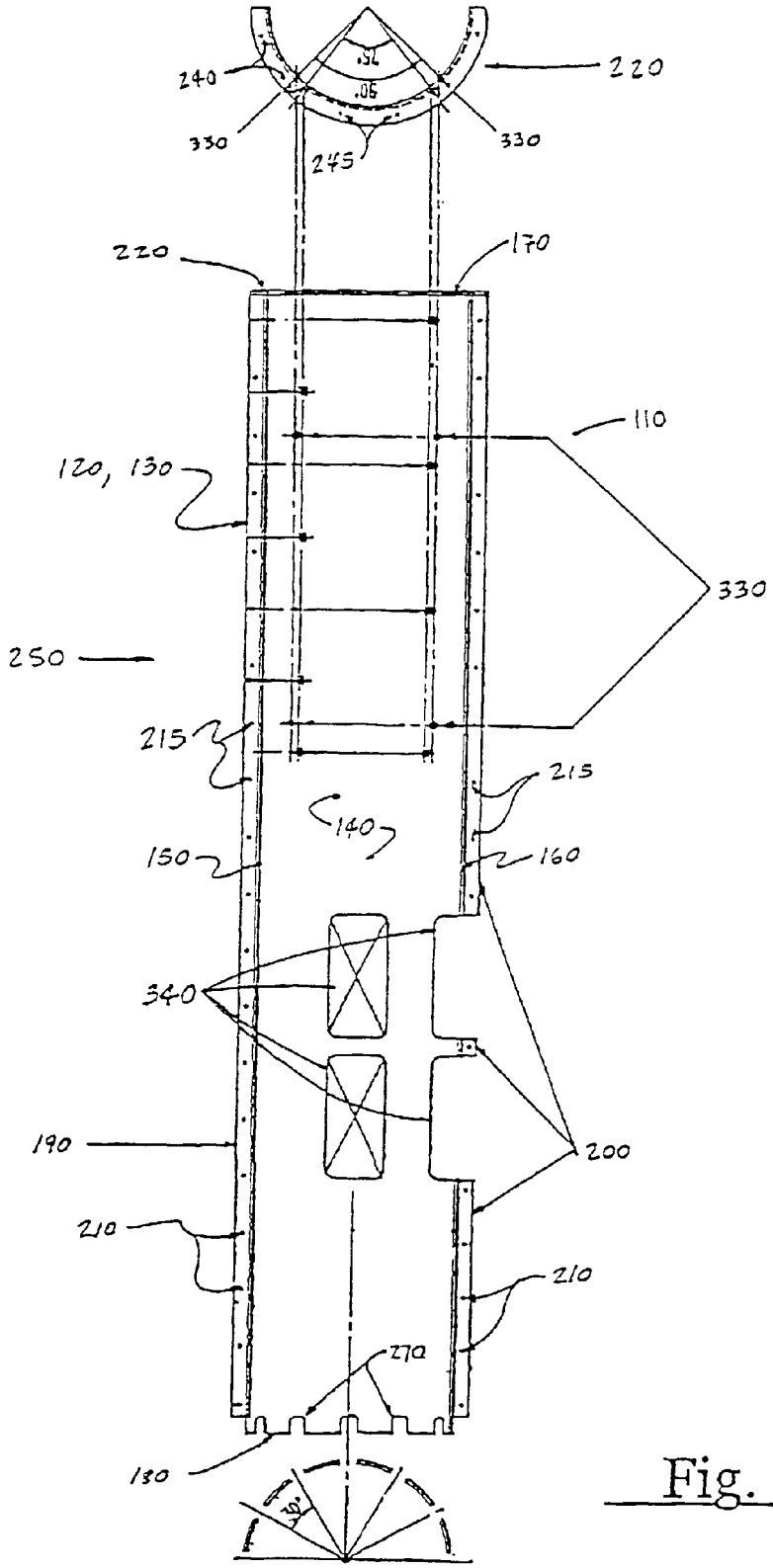
FIG. 2 is a plan view of a bottom sleeve section of the present invention showing the access ports, the load transfer bolts, and the flange plates.
Figure 3:
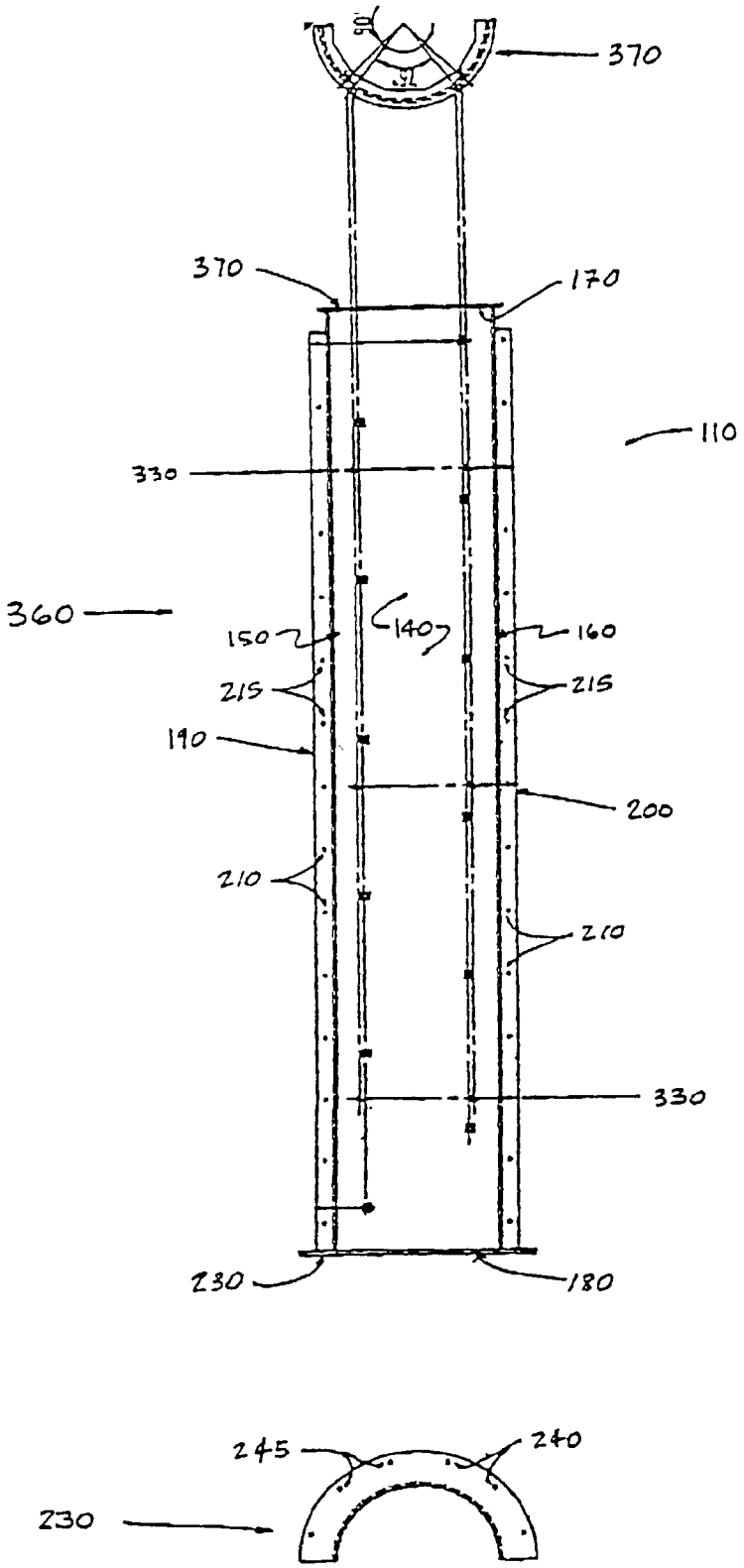
FIG. 3 is a plan view of a top sleeve section of the present invention showing the access ports, the load transfer bolts, and the flange plates.

FIGS. 1-3 show the support structure 100 of the present invention. The support structure 100 includes one or more sleeves 110. The sleeves 110 may be up to about thirty (30) feet in length. Sleeves 110 of more than thirty (30) feet may be used. As is shown particularly in FIGS. 2-3, the sleeves 110 each may be a two (2) part structure with a first half 120 and a second half 130. The halves 120, 130 have a largely semi-circular portion 140, a first side 150, a second side 160, a top portion 170, and a bottom portion 180. The semi-circular portion 140 extends in width from the first side 150 to the second side 160 and in length from the top portion 170 to the bottom portion 180. The halves 120, 130 of the sleeves 110 may be a molded structure or may be manufactured by other types of conventional construction means. The halves 120, 130 may be made from substantially rigid materials such as hot-dipped galvanized ASTM A572 structural pipe having a minimum yield stress of about 42 ksi. It will be appreciated that other materials are equally suitable for the method and apparatus disclosed herein depending upon the desired characteristics of the support structure 100 as a whole.

Both halves 120, 130 may have a first sleeve tab 190 extending substantially perpendicularly from the semicircular portion 140 along the first side 150 of the halves 120, 130 and a second sleeve tab 200 extending substantially perpendicularly from the semi-circular portion 140 along the second side 160 of the halves 120, 130. The sleeve tabs 190, 200 may be a unitary element with the halves 120, 130 (i.e., molded therewith) or the sleeve tabs 190, 200 may be a flat bar or a similar structure that is welded to the halves 120, 130. The welding preferably should comply with AWS A5.1 or A5.5, E70xx standards. The sleeve tabs 190, 200 may be made from the same material as the halves 120, 130. Alternatively, the sleeve tabs 190, 200 also may be made from a hot-dipped galvanized ASTM A-36 structural steel or similar materials if the sleeve tabs 190, 200 are welded to the halves 120, 130.

The sleeve tabs 190, 200 may have a plurality of apertures or bolt holes 210 therein that align so as to connect the respective halves 120, 130 by bolts 215 or other conventional types of fastening means. The bolts 215 preferably should comply with ASTM A-325 standards. When joined along the sleeve tabs 190, 200, the halves 120, 130 of the sleeves 110 form a largely hollow structure with a diameter slightly greater that the greatest diameter of that section of the pole 20 the particular sleeve 110 is intended to surround.

The sleeves 120, 130 may have a first flange plate 220 encircling the top portion 150 of both halves 120, 130 and a second flange plate 230 encircling the bottom portion 180 of both halves 120, 130. The flange plates 22o, 230 may be a flat semicircular bar or a similar structure that is welded to the halves 120, 130 of the sleeve 110. The welding preferably should comply with AWS A5.1 or A5.5, E70xx standards. The width of the Age plates 220, 230 may vary so as to accommodate the additional sleeves 110 of varying size. The flange plates 220, 230 may have a plurality of apertures or bolt holes 240 therein so as to connect the sleeves 110 by a number of bolts 245 or by other conventional types of fastening means as described in more detail below. The bolts 245 should comply with AST A-325 standards. The flange plates 220, 230 may be made from the same material as the halves 120, 130. Alternatively, the flange plates 220, 230 also may be made from hot-dipped galvanized ASTM A-36 structural steel or similar materials if the flange plates 220, 230 are welded to the halves 120, 130.

Figure 4:
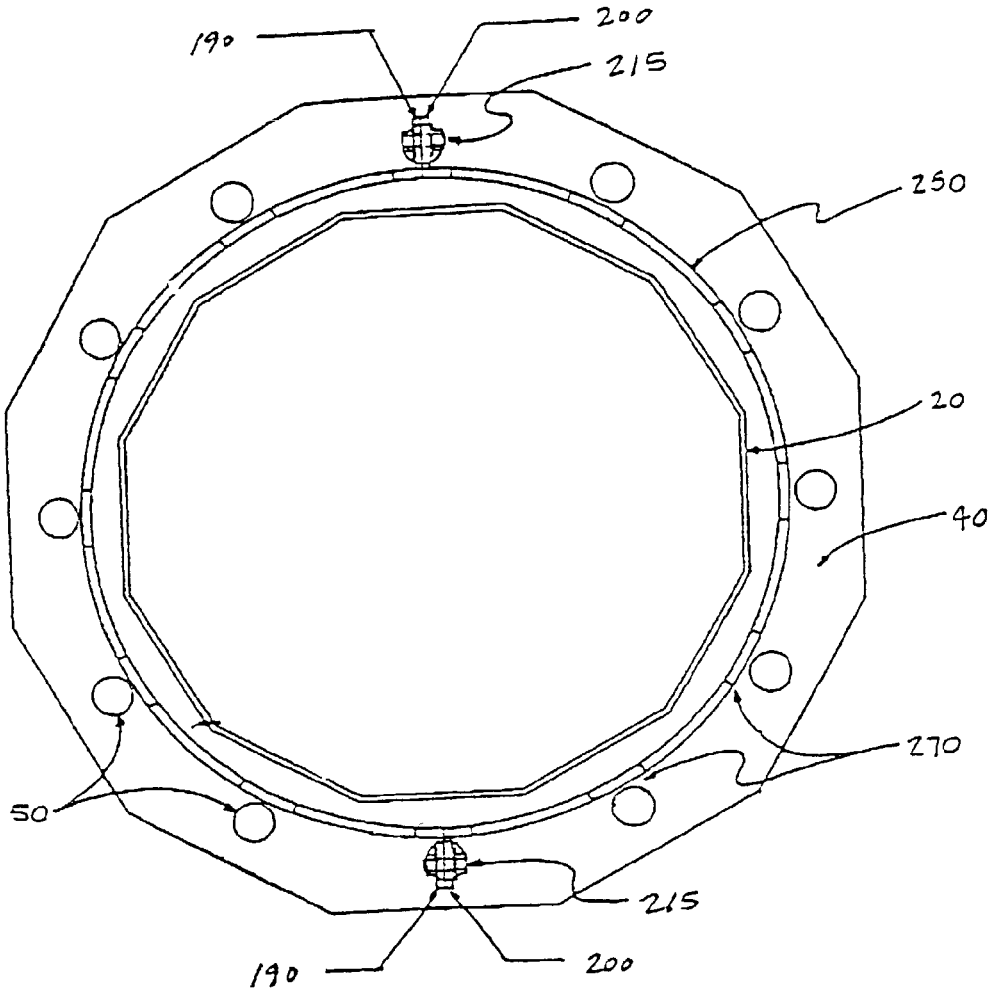
FIG. 4 is a top cross-sectional view of the sleeves and the existing pole.

FIGS. 1 and 4 show the sleeve 110, in this case a first sleeve 250, encircling an existing pole 20 and attached to the existing foundation 30. The sleeve 250 may be attached to the foundation 30 by a number of the bolts 245 anchoring the second flange plate 230 of the bottom portion 180 of each half 120, 130 of the sleeve 250. The halves 120, 130 of the sleeve 250 are positioned around the existing pole 20 such that the central vertical axis of sleeve 250 is centered on the effective center vertical axis of existing pole 20. The size of the bolts 245 will depend upon the size and intended use of the support structure 100 as a whole. The first sleeve 250 may have a number of cutout portions 270 therein along the bottom portion 130 of each half 120, 130 so as to accommodate either the existing anchor bolts 50 or the bolts 245 for use herewith. The second flange plate 230 also may be fixedly connected to existing base plate 40.

Figure 7:
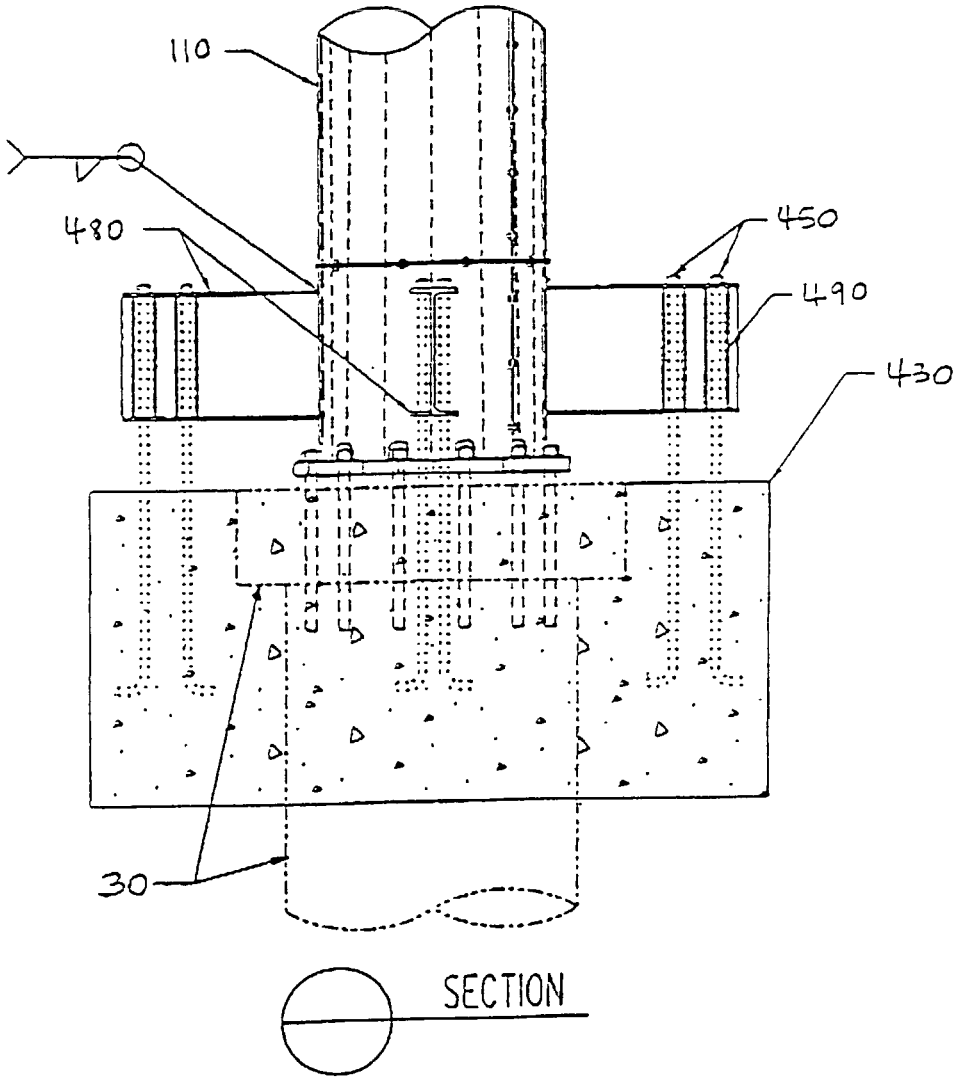
FIG. 7 is a sectional view of the sleeve at the base showing the beams, the anchoring means, and the foundation as disclosed in one embodiment.
Figure 8:
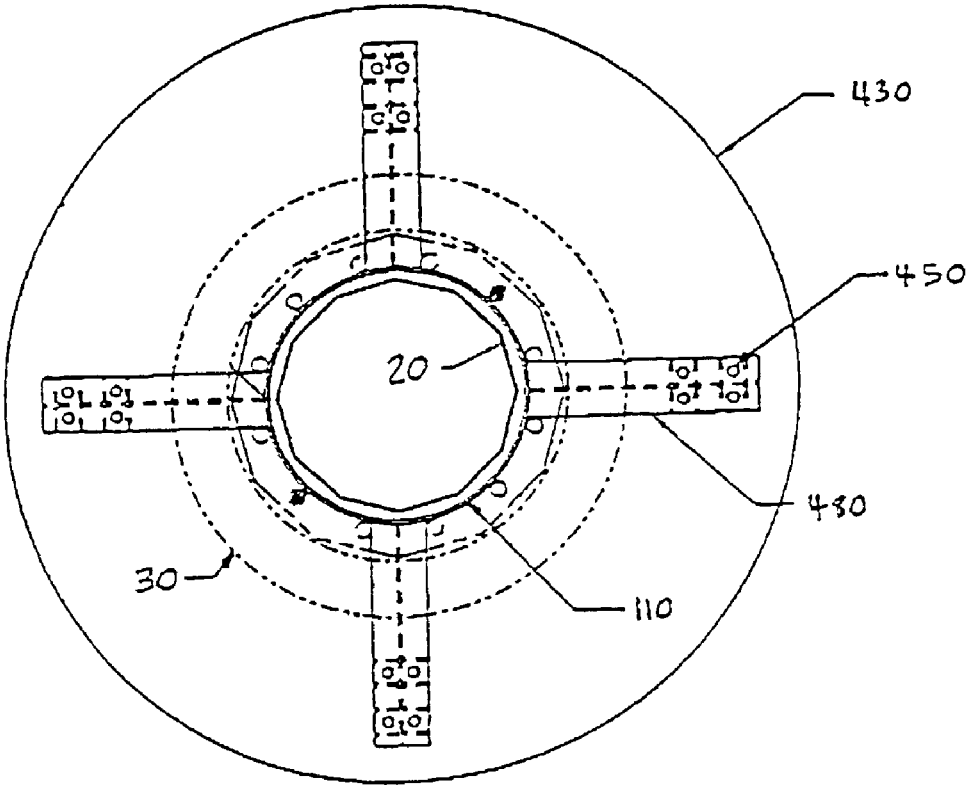
FIG. 8 is a top cross-sectional view of the sleeve near the base showing the beams, the anchoring means, and the foundation as disclosed in one embodiment.

FIGS 7 and 8 show the existing foundation 30 and a new foundation 430. A number of beams 480 may be attached to the sleeve 110 to facilitate anchoring and to provide additional structural support and stability. The beams 480 may be positioned around the sleeve 110 and may extend outward radially. Each beam 480 may be shaped at its attachment to the sleeve 110 to form a close fit. The sleeve 110 may be attached to the existing foundation 30 or to the new foundation 430 using a number of new anchor bolts 450. The beams 480 may include a number of stiffener plates 490 adjacent the new anchor bolts 450. The number and size of the beams 480, the stiffener plates 490, and the new anchor bolts 450 will depend upon the size and intended use of the support structure 100 as a whole.

Figure 5:
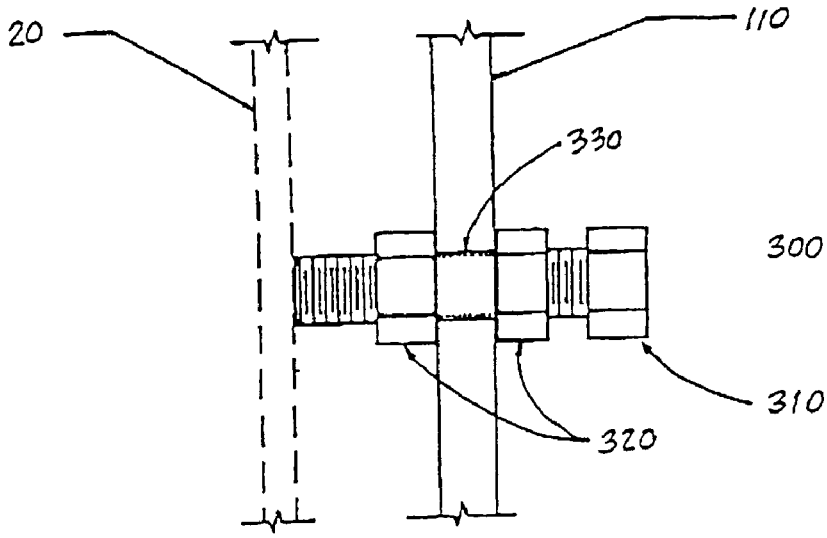
FIG. 5 is a side plan view of the load transfer bolts.

Positioned along the length of the sleeves 110 may be a number of load transfer pins 300. As is shown in FIG. 5, the load transfer pins 300 each may include a bolt 310 and one or more nuts 320. Similar types of load transfer means may be used, The bolt 310 may be positioned within one of a number of load transfer boltholes 330 located along the length of the sleeves 110. One of the nuts 320 may be positioned on the bolt 310 on the inside of the sleeve 110 and one nut 320 may be positioned on the bolt 310 on the outside. The bolt 310 extends and contacts the existing pole 20. The bolt 310 may be turned until contact is made with the existing pole 20, at which time the outer nut 320 is tightened to firmly secure the load transfer pin 300.

FIG. 2 illustrates the location of the holes 330 for the load transfer pins 300 in the first sleeve 250. The load transfer pins 330 may be spaced in an array that is suitable for the expected load to be supported by the support structure 100. The load transfer pins 300 are spaced apart in an array both vertically and radially. Vertical spacing is designed relative to the height the sleeves 110. Radial spacing is designed relative to the vertical center axis of sleeves 110. As is shown, the load transfer pins 50 may be vertically spaced about twelve (12) to sixty (60) inches apart and radially spaced about ninety degrees (90°) apart.

The sleeves 110 also may have one or more access ports 340 positioned therein. The access ports 340 may be apertures of varying size and shape in the sleeves 110. The access ports 340 provide access to the interior wires or cables on the existing pole 20 for inspection, repair, or the addition of new wing or cables.

Figure 6:
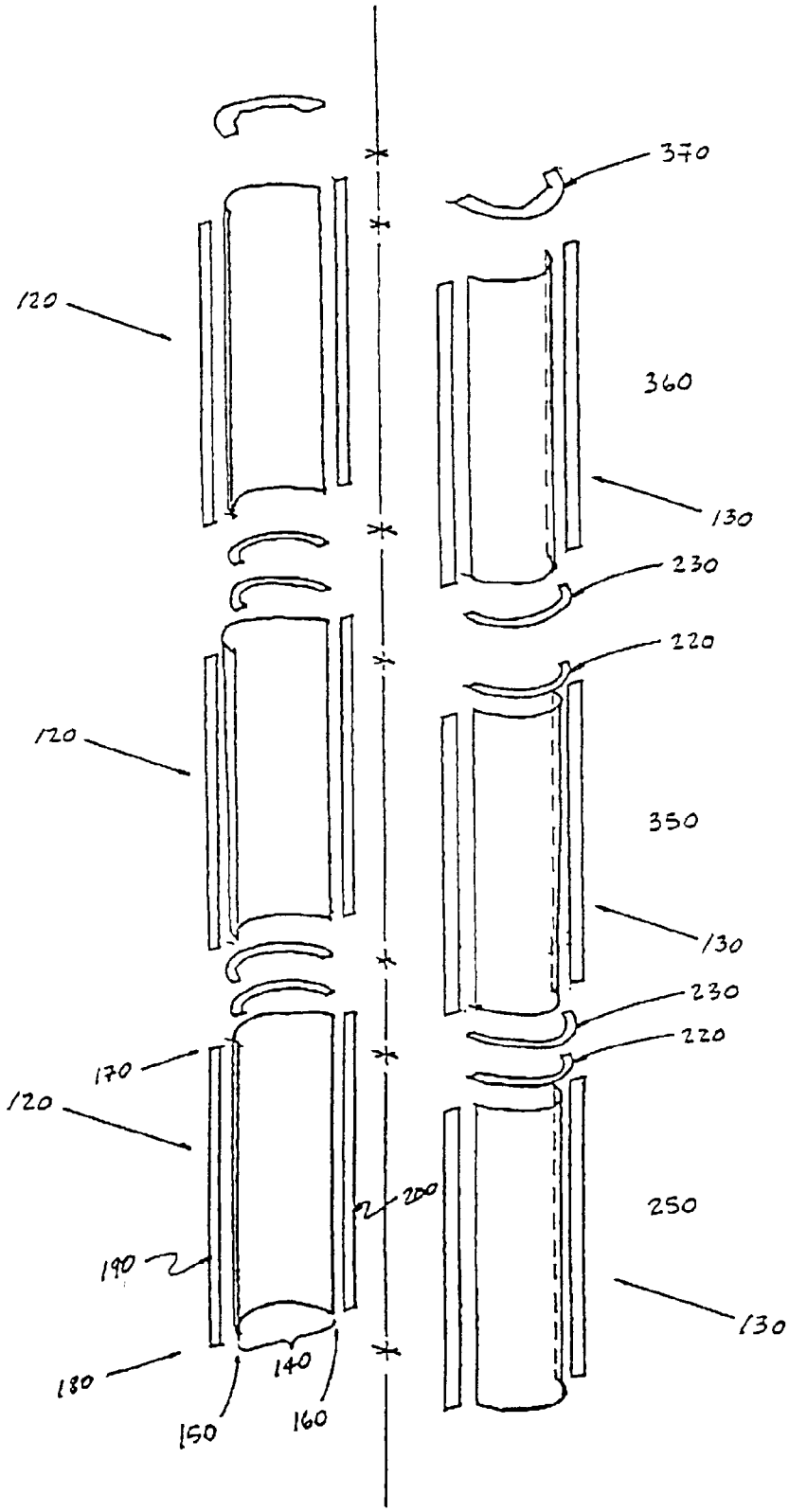
FIG. 6 is an exploded view of the sleeves.

As is shown in FIGS. 1 and 6, a number of the sleeves 110 may be combined herein. For example, FIG. 6 shows the use of three sleeves 110, the first sleeve 250, a second sleeve 350, and a third sleeve 360. Any number of the sleeves 110 may be used. The sleeves 110 may be of varying size in terms of shape, length, width, or thickness. Further, sleeves 110 of varying size and shape may be used together. As described above, the existing pole 20 is likely to be tapered in width as the pole 20 extends in height. Each sleeve 250, 350, 360 therefore may be progressively smaller in height, width, and thickness.

For example, the first sleeve 250 may have a height of about twenty (20) feet, a width of about forty-two (42) inches, and a thickness of about ⅝-inch, the second sleeve 350 may have a height of about twenty (20) feet, a width of about thirty-six (36) inches, and a thickness of about ⅝-inch; and the third sleeve 360 may have a height of about fifteen (15) feet, a width of about thirty (30) inches, and a thickness of about ⅝-inch or less. The first flange plate 220 of the first sleeve 250 accommodates the second flange plate 230 of the second sleeve 350 while the first flange plate 220 of the second sleeve 350 accommodates the second flange plate 230 of the third sleeve 360. For example, the first flange plate 220 of the first sleeve 250 and the second flange plate 230 of the second sleeve 350 may have a diameter of about forty-eight (48) inches while the first flange plate 220 of the second sleeve 350 and the second flange plate 230 of the third sleeve 360 each may have a diameter of about forty-two (42) inches. The sleeves 250, 350, 360 are connected by the bolts 245 as described above. Each sleeve 250, 350, 360 also has a plurality of load transfer pins 300 as described above.

The third sleeve 360, or whichever sleeve 110 is positioned on top, may be sealed at the top with a cover plate 370. The cover plate 370 extends in a close fit from the perimeter of the existing pole 20. The cover plate 370 may be sealed in a watertight fashion with a silicone sealant. The cover plate 370 may be constructed of ¼-inch steel, such as hot-dipped galvanized ASTM A-36 structural steel or similar materials. The cover plate 370 may be welded to the top of the third sleeve 360.

Positioned on the support structure 100 may be one or more telecommunications arrays 380. The telecommunication arrays 380 may be of conventional design and may be identical to the existing telecommunication array 70. The telecommunication arrays 380 may be attached to the support structure 100 by bolts or by other conventional types of attachment means. As is shown in FIG. 1, the existing telecommunication array 70 may remain positioned on the existing pole 20 while new arrays 380 are added to the support structure 100. Alternatively, the original array 70 and the new arrays 380 may be positioned on the support structure 100. The support structure 100 may have a height that is less than, equal to, or greater than the height of the existing pole 20. The support structure 100 may support any type of load in addition to the telecommunications arrays 380.

In use, the support structure 100 as described herein should be able to support loads of about two thousand (2,000) to forty thousand (40,000) pounds at heights of between about thirty (30) to two hundred fifty (250) feet while withstanding basic wind speeds of up to about seventy (70) miles per hour or a combined environmental load of wind at about sixty (60) miles per hour and a layer of radial ice of about one-half-inch thick surrounding the support structure 100. The support structure 100 has adequate independent strength and stability to support its telecommunication arrays 380 while also combining with the existing pole 20 via the load transfer pins 300 to provide superior strength and stability to the combined structure as a whole. The present invention thus provides an apparatus and method for increasing the load and stability of single pole towers so as to increase the number of telecommunication arrays in use without the need to build additional towers.

It should be apparent that the foregoing relates only to a preferred embodiment of the present invention and that numerous changes and modifications may be made hem without departing from the spirit and scope of the invention as defined by the following claims.

The invention claimed is:

1. A method for increasing a capacity and stability of a previously erected single pole cellular tower, said previously erected single pole cellular tower comprising a pole anchored to a foundation, said method comprising the steps of:

positioning at least one sleeve around said pole such that the capacity and stability of said previously erected single pole cellular tower is increased; and attaching cellular communication equipment to said pole after said positioning step.

2. The method of claim 1, further comprising the step of anchoring said sleeve to said foundation.

3. The method of claim 1, wherein said sleeve is composed of metal.

4. The method of claim 1, wherein said sleeve has a length of at least 20 feet.

5. A method for use with a previously erected single pole tower, said previously erected single pole tower comprising a pole anchored to a foundation and attached to first telecommunication equipment configured to wirelessly communicate with remote communication devices within a vicinity of said previously erected single pole tower, said method comprising the steps of:

increasing a capacity and stability of said previously erected single pole tower, said increasing step comprising the step of positioning at least one sleeve around said pole; and attaching second telecommunication equipment to said previously erected single pole power subsequent to said increasing step, said second telecommunication equipment configured to wirelessly communicate with remote communication devices within a vicinity of said previously erected single pole tower.

6. The method of claim 5, further comprising the step of anchoring said sleeve to said foundation.

7. The method of claim 5, wherein said foundation is composed of concrete.

8. The method of claim 5, wherein said first telecommunication equipment remains attached to said pole during said increasing and attaching steps.

9. A method for use with a previously erected single pole tower, said previously erected single pole tower comprising a pole anchored to a foundation and attached to first telecommunication equipment configured to wirelessly communicate with remote communication devices, said method comprising the steps of:

enabling second telecommunication equipment to be mounted on said previously erected single pole tower, said enabling step comprising the step of positioning at least one sleeve around said pole such that a capacity and stability of said previously erected single pole tower is increased; and attaching said second telecommunication equipment to said previously erected single pole tower, said second telecommunication equipment configured to wirelessly communicate with remote communication devices.

10. The method of claim 9, wherein said positioning comprises attaching said at least one sleeve to a foundation.

11. The method of claim 9, wherein said second telecommunication equipment is configured to transmit a wireless cellular signal directly to a mobile cellular device.

12. The method of claim 9, wherein said first telecommunication equipment remains attached to said pole during said enabling and attaching steps.

13. A method for use with a previously erected single pole cellular tower, said previously erected single pole cellular tower comprising a pole anchored to a foundation and attached to first cellular communication equipment, said method comprising the steps of:

positioning at least one sleeve around said pole thereby increasing a capacity and stability of said previously erected single pole cellular tower such that said previously erected single pole cellular tower is able to sufficiently support second cellular communication equipment; and attaching said second cellular communication equipment to said previously erected single pole cellular tower subsequent to said positioning step.

14. A method for use with a previously erected single pole tower, said previously erected single pole tower comprising a pole anchored to a foundation and attached to first telecommunication equipment for wirelessly communicating with remote devices, said method comprising the steps of:

positioning at least one sleeve around said pole thereby increasing a capacity and stability of said previously erected single pole tower such that said previously erected single pole tower is able to sufficiently support second telecommunication equipment for wirelessly communicating with remote devices; and attaching said second telecommunication equipment to said previously erected single pole tower subsequent to said positioning step.

15. The method of claim 14, wherein said pole is hollow.

16. The method of claim 15, wherein said pole is tapered.

17. The method of claim 14, wherein said first telecommunication equipment remains attached to said pole during said positioning and attaching steps.

18. The method of claim 14, further comprising the steps of:

wirelessly communicating cellular signals from said first telecommunication equipment to mobile cellular devices prior to said positioning step; and wirelessly communicating cellular signals from said second telecommunication equipment to mobile cellular devices subsequent to said positioning step.

19. The method of claim 18, further comprising the step of wirelessly communicating cellular signals from said first telecommunication equipment to mobile cellular devices subsequent to said positioning step.

20. A method for increasing a stability and capacity of a previously erected monopole tower, said previously erected monopole tower attached to a foundation, comprising the steps of:

positioning at least one sleeve around said previously erected monopole tower thereby increasing said stability and capacity of said previously erected monopole tower; and attaching cellular communication equipment to said previously erected monopole tower after said positioning step.

21. The method of claim 20, wherein a total weight of cellular communication equipment simultaneously residing on said previously erected monopole tower after said attaching step exceeds a total weight of cellular communication equipment simultaneously residing on said monopole tower prior to said positioning step.

22. The method of claim 20, wherein cellular communication equipment is attached to said previously erected monopole tower prior to said positioning step.

23. The method of claim 20, wherein said previously erected monopole tower, prior to said positioning step, is attached to cellular communication equipment that is used, prior to said positioning step, to communicate with remote cellular devices.

24. The method of claim 20, wherein said previously erected monopole tower, prior to said positioning step, is insufficient for supporting all of the cellular communication equipment simultaneously residing on said previously erected monopole tower after said attaching step.

25. A method for increasing a capacity of a previously erected single pole tower, said previously erected single pole tower comprising a pole anchored to a foundation and having an original capacity upon erection of said single pole tower, said method comprising the steps of:

positioning at least one sleeve around said pole such that the capacity of said previously erected single pole tower is increased; and attaching wireless communication equipment to said pole after said positioning step, wherein the capacity of said previously erected single pole tower after said positioning step is greater than said original capacity.

* * * * *